United States Patent [19]

Grabb

[11] 4,398,871

[45] Aug. 16, 1983

[54] MOVABLE END PLATE FOR A VACUUM PUMP

[75] Inventor: Frederick G. Grabb, South Bend, Ind.

[73] Assignee: The Bendix Corporation, Southfield, Mich.

[21] Appl. No.: 304,763

[22] Filed: Sep. 23, 1981

Related U.S. Application Data

[62] Division of Ser. No. 107,125, Dec. 26, 1979, Pat. No. 4,336,004.

[51] Int. Cl.[3] ..... F04B 49/02; F04B 49/08

[52] U.S. Cl. ..... 417/283; 417/310

[58] Field of Search ..... 417/283, 310

[56] References Cited

U.S. PATENT DOCUMENTS

| | | | |
|---|---|---|---|
| 2,845,868 | 8/1958 | Norlin | 417/283 |
| 2,977,886 | 4/1961 | Banker | 417/283 |
| 3,182,596 | 5/1965 | Prijatel | 417/310 X |

FOREIGN PATENT DOCUMENTS

| | | | |
|---|---|---|---|
| 5248806 | 10/1975 | Japan | 417/283 |

*Primary Examiner*—Richard E. Gluck

*Attorney, Agent, or Firm*—Leo H. McCormick, Jr.; Ken C. Decker

[57] ABSTRACT

A movable section of a housing of a pump that permits an inlet port to be connected to an outlet port whenever a predetermined fluid pessure differential develops therebetween to reduce the work required to move a wall between the input port and the output port by an input member.

2 Claims, 5 Drawing Figures

MOVABLE END PLATE FOR A VACUUM PUMP

This is a division of application Ser. No. 107,125, filed Dec. 26, 1979, now U.S. Pat. No. 4,336,004.

BACKGROUND OF THE INVENTION

This invention relates to a rotary pump having an end plate that is moved out of engagement with vanes therein to provide an unrestricted flow path between an inlet port and an outlet port whenever the fluid pressure differential reaches a predetermined value to thereafter reduce the work required to move the vanes by an input member.

In known pumps, the only way of reducing the work required to rotate the vanes is to disengage the input member from the power source through some type of clutch arrangement. Unfortunately when the power source is continually operating, noise can be created during the engagement of the clutch. In addition the cost of such clutches can limit the application of the pump.

With an increasing awareness of fuel efficiency it is estimated that up to 25% of the vehicles manufactured in 1985 will be powered by diesel engines. In order to provide continuity between the accessories used with internal combustion and diesel engines it will be necessary to provide a source of vacuum to operate many of the accessories. It has been determined that a continually operating pump can reduce the fuel efficiency of a diesel engine by about 5%. Since such a pump must be sized to meet peak demand of the accessories, during normal operation of the vehicle the demand for vacuum could be non-existent once the reserve capacity of vacuum is met. Thus, for optimum fuel efficiency, it is inoperative that the input force driving the pump be reduced once the operational demand for vacuum is achieved.

SUMMARY OF THE INVENTION

I have devised a pump having an operational chamber therein in which a wall moves a fluid from an inlet port to an outlet port in response to a force applied thereto by an input member. As the wall moves fluid through the chamber, a pressure differential develops between the inlet and outlet ports. The improvement is characterized by a sector member that moves in response to a predetermined pressure differential and connects the inlet port to the outlet port to reduce the work required by the input member to move the wall in the chamber.

In a first embodiment of the pump, the sector member is the end plate of the housing that engages the vanes in a rotary pump. A spring holds the end plate against the vanes until the predetermined pressure differential is achieved. Thereafter, the force created by this predetermined pressure differential acts on the end plate and overcomes the spring to allow communication between the inlet port and the outlet port. With the inlet port connected to the outlet port through the operational chamber, the work required to rotate the vanes is negligible.

In a second embodiment of the pump the sector member is a section of the side wall of the housing that is moved away from a relief port to provide communication between the inlet and outlet ports and the surrounding environment to substantially eliminate a pressure differential between the inlet and outlet ports and thus the work required by the input member to rotate the vanes.

An advantage of this invention is that it reduces the work required to operate a continually running pump when an operational pressure level is developed between an inlet port and an outlet port.

An object of this invention is to provide a pump with a structure that connects the inlet port to the outlet port whenever a predetermined pressure level is created therebetween.

It is a further object of this invention to provide a pump with a sensor that responds to a predetermined pressure differential between an inlet port and an outlet port and allows a sector member to move and establish a flow path through the pump that reduces the work required to operate the pump.

DETAILED DESCRIPTION OF THE INVENTION

Figure 1:
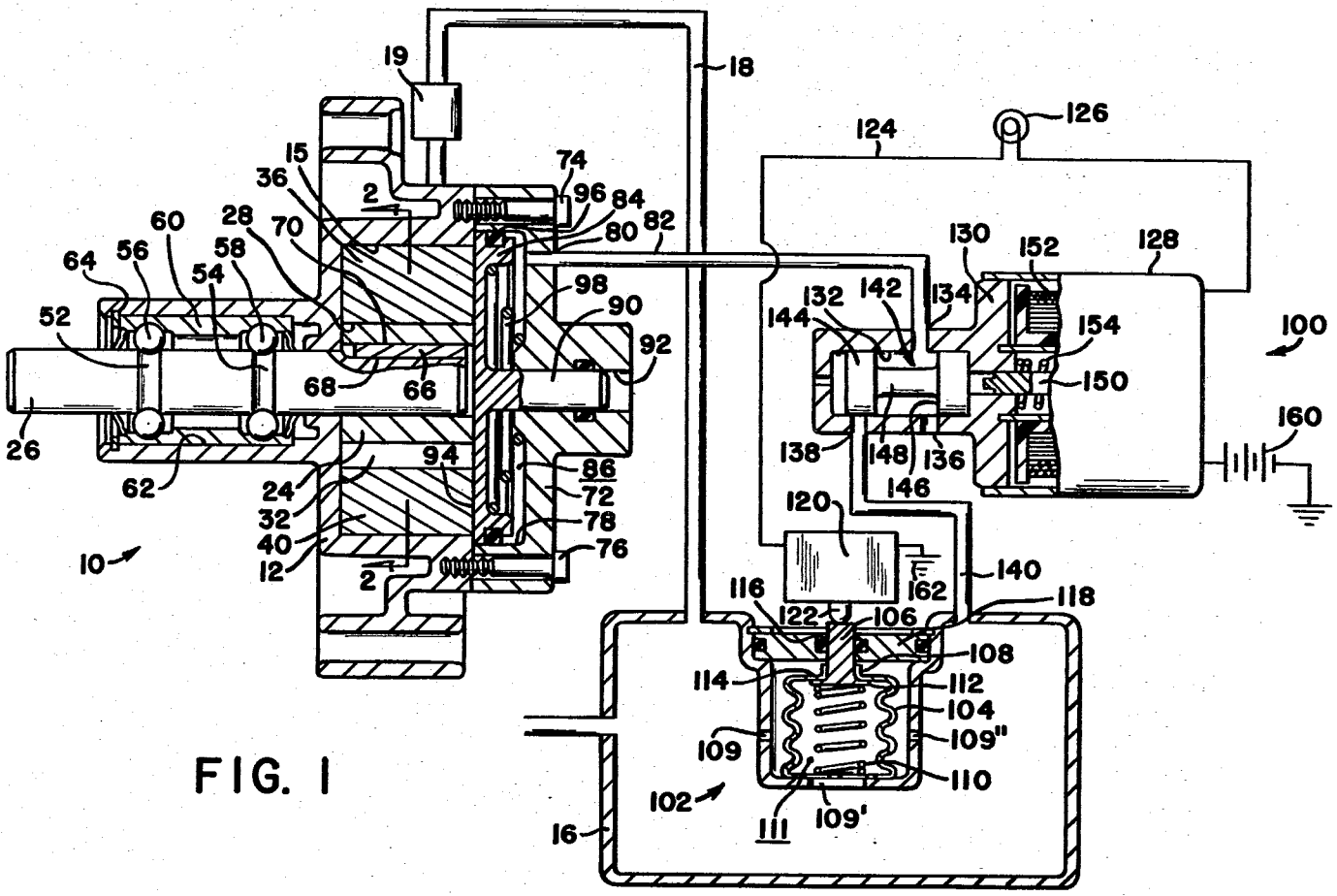
FIG. 1 is a schematic illustration of a pump made according to the principles of this invention.
Figure 2:
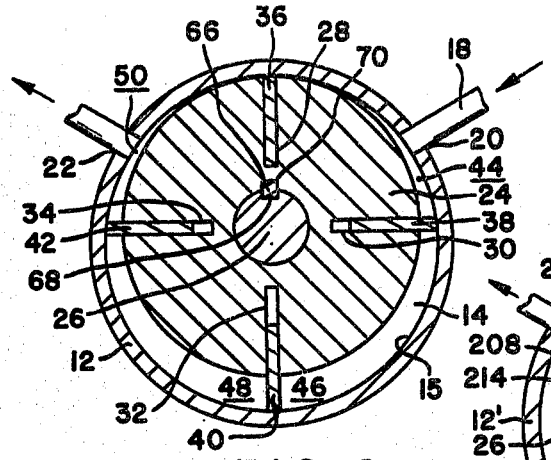
FIG. 2 is a sectional view taken along lines 2—2 of FIG. 1.

The pump 10 shown in FIG. 1 has a housing 12 with a cavity 14 therein. The cavity 14 has an inlet port 20, see FIG. 2, which is connected to a reservoir 16 by a conduit 18 and an outlet port 22. A rotor 24 is eccentrically positioned in cavity 14 by a shaft 26. The rotor 24 has a series of radial slots 28, 30, 32, 34 located at substantially 90° from each other in which vanes 36, 38, 40 and 42 are retained. Vanes 36, 38, 40 and 42 form a series of walls which cooperate with housing 12 to define a series of distinct chambers 44, 46, 48 and 50 in cavity 14. Because of the eccentric position of the rotor 24 in cavity 14, the size of chambers 44, 46, 48 and 50 is continually varying whenever a rotary input is supplied to shaft 26 by a driving or input member to move the vanes or wall in the cavity 14.

Shaft 26 has first and second races 52 and 54 in which balls 56 and 58 of bearing housing 60 are retained. Bearing housing 60 is retained in bore 62 of housing 12 by a snap ring fastener 64. A key 66 located between slot 68 on the end of shaft 26 in cavity 14 and slot 70 in rotor 24 assure that each revolution of shaft 26 is transmitted into rotor 24.

An end cap 72 is attached to housing 12 by a series of bolts 74, 76. The end cap 72 has a bore 78 located therein with a control port 80 connected by conduit 82 to the supply reservoir 16. A cylindrical plate or sector member, or wall 84 separates bore 78 into a control chamber 86 and a by-pass chamber 88, see FIG. 3. The cylindrical end plate or wall 84 has a projection 90 that is located in bore 92 in the housing 72 in order to maintain surface 94 in a plane substantially perpendicular to bore 15 in housing 12 and bore 78 in housing 78. A seal 96 is attached to the peripheral surface of the end plate or wall 84 to prevent fluid communication between the control chamber 86 and the by-pass chamber 88. A spring 98 located in the control chamber 86 acts on the back side of the end plate or wall 84 and urges face 94 into engagement with vanes 36, 38, 40 and 42 to prevent fluid communication between the inlet port 18 and the outlet port 22 under the operational conditions shown in FIG. 1.

A control valve 100 located in conduit 82 receives an operational signal from a sensor member 102 located in the reservoir 16 to control the communication of fluid to control chamber 86.

The sensor member 102 which is an evacuated bellows responds to an absolute pressure change such as differences in altitude. The sensor member 102 includes a corrugated cylindrical body 104 with a stem member 106 extending through an opening 108 therein. A spring 110 located in the cylindrical body 104 urges a head 112 on the stem member 106 against the closure cap 114 of the cylindrical body 104. The stem member 106 extends through a sealed opening 116 in a retainer 118 and engages a control 122 on a relay switch 120.

The relay switch 120 is connected by lead 124 to an indicator light 126 and a solenoid 128 in the control valve 100.

The solenoid 128 has a housing 130 with a bore 132 located therein. Bore 132 has a first port 134 which is connected to control chamber 86 by conduit 82, a second port 136 which is connected to the surrounding environment and a third port 138 which is connected to reservoir 16 by conduit 140. A spool 142 has a first land 144 separated from a second land 146 by a stem 148. A plunger 150 located in coil 152 of the solenoid 128 is attached to the spool 142. A spring 154 acts on plunger 150 to move the lands 144 and 146 on spool 142 to a position shown in FIG. 1 to provide unrestricted fluid communication between control chamber 86 and the surrounding environment by way of port 136, bore 132, port 134 and conduit 82.

MODE OF OPERATION OF THE INVENTION

It is intended that when a vehicle equipped with a pump 10 is operating, a continual rotary input is applied to shaft 26 through some type of connection with the crankshaft. When shaft 26 rotates, rotor 24 rotates to move vanes 36, 38, 40 and 42 in cavity 14. The centrifugal force generated by the rotation of rotor 24 causes the ends of vanes 36, 38, 40 and 42 to engage surface 15 and thereby separated chambers 44, 46, 48 and 50 from each other.

As a vane moves past inlet port 20, air or fluid is drawn past check valve 19 and into the chamber until the next vane moves past the inlet port. The air or fluid drawn into the chamber is transmitted through the cavity 14 and expelled through the outlet port 22 into the surrounding environment or into the intake manifold or air cleaner of the vehicle. The dumping of air or fluid into the intake manifold or air cleaner is preferred since it is a silent way of disposing of the air.

As the vanes 36, 38, 40 and 42 continue to move air or fluid from the inlet port 20 to the outlet port 22 through cavity 14, the pressure level in reservoir 16 is lowered. This lower pressure allows the corrugated cylinder 104 to expand. As cylinder 104 expands, spring 110 moves stem member 106 toward relay contact 122. At some predetermined pressure level, the expansion of cylinder 104 is such that stem member 106 moves relay contact 122 into a position to operate switch 120 and close an electrical circuit between power source 160 and ground 162. With this electrical circuit closed, light 126 operates and provides a visual indication that the reservoir pressure level is at a predetermined value and coil 152 in solenoid 128 is energized. With coil 152 energized, the magnetic field created therein attempts to move plunger 150 to the center of the magnetic field. As plunger 150 moves, stem 142 also moves to interrupt communication from the surrounding environment through port 136 and initiate communication between reservoir 16 and control chamber 86 by way of conduit 140, port 138, bore 132, port 134 and conduit 82.

Figure 3:
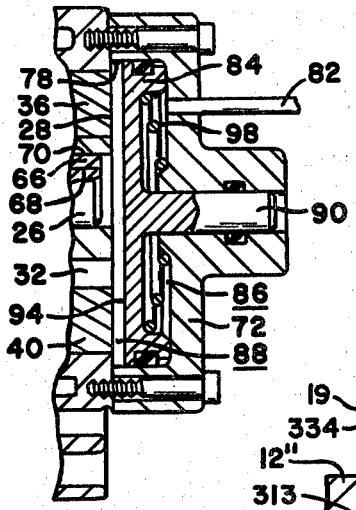
FIG. 3 is a sectional view of a portion of the pump in FIG. 1 showing the end wall moved out of engagement with the vanes to provide flow communication between the inlet port and outlet port according to the principles of the invention.

Thus, the lowered fluid pressure of air or fluid in the reservoir 20, which is the same as the fluid pressure adjacent the inlet port 16, is communicated into the control chamber 86. Since the end plate or wall 84 has at least one-fourth of its surface area exposed to the fluid pressure (atmospheric pressure) at the outlet port 22, a pressure differential is created across the end plate or wall 84 with fluid at a lower pressure in the control chamber 86. This pressure differential acts on the end plate or wall 84 and overcomes spring 98 to move surface 94 on the end plate or wall 84 out of engagement with vanes 36, 38, 40 and 42 as shown in FIG. 3 to establish by-pass chamber 88. With flow communication establish between the inlet port and outlet port through the by-pass chamber 88, the resistance to movement of the vanes in cavity 14 is substantially eliminated and thus the work required to rotate shaft 26 correspondingly reduced.

As the fluid pressure in reservoir 16 rises due to depletion thereof by vacuum operated accessories, this same pressure rise is communicated to the corrugated cylinder 104 through passages 109, 109′, 109″, etc. A rise in the fluid pressure acts on the surface of the corrugated cylinder 104 and causes a contraction of the same since the fluid pressure in evacuated chamber 111 is lower than that in the reservoir 16. When corrugated cylinder 104 has contracted a predetermined distance corresponding to a rise in the pressure level in the reservoir, stem member 106 is moved away from relay contact 122. After a predetermined amount of movement, relay contact 122 opens switch 120 to interrupt electrical current flow in lead 124. With switch 120 opened, the magnetic field in coil 152 decays and spring 154 moves plunger 150 and spool 142 to the position shown in FIG. 1. Thereafter, air from the surrounding environment is communicated to the control chamber 86 to eliminate the pressure differential across end plate or wall 84. With the pressure differential eliminated, spring 98 moves the end plate or wall 84 such that surface 94 engages vanes 36, 38, 40 and 42 to prevent fluid communication between the inlet port 20 and outlet port 22 through the by-pass chamber 88. Thereafter, the vanes 36, 38, 40 and 42 evacuate air from the reservoir 16 to reduce the fluid pressure therein in order to meet a vacuum demand of the accessories. When the pump 10 has again reduced the fluid pressure in the reservoir to a preselected level, sensor member 102 again operates the switch 120 through which electrical energy is supplied to solenoid 100 to allow the fluid pressure in reservoir 16 to be communicated to control chamber 86 and re-establish a pressure differential across the wall or end plate 84. When this pressure differential is sufficient to overcome spring 98, end plate or wall 84 moves to establish the by-pass chamber 88 through which the inlet port 20 is connected to the outlet port 22 to reduce the resistance to movement of the vanes 36, 38, 40 and 42 in the cavity 14 and correspondingly the work required to rotate shaft 26.

Thus, the output of pump 10 is directly proportional to the vacuum or pressure level in reservoir 16 which is dependent on the operational need of the accessories.

Figure 4:
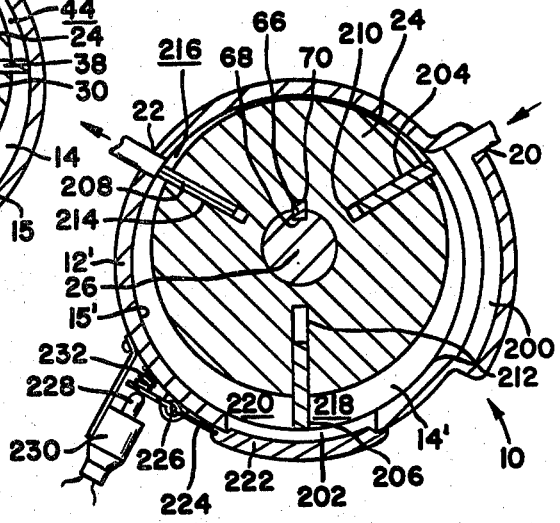
FIG. 4 is a sectional view of the pump showing a relief port through which the inlet and outlet ports are connected to the surrounding environment to reduce the work required to rotate the vanes when a predetermined pressure differential develops between the inlet and outlet ports.
Figure 5:
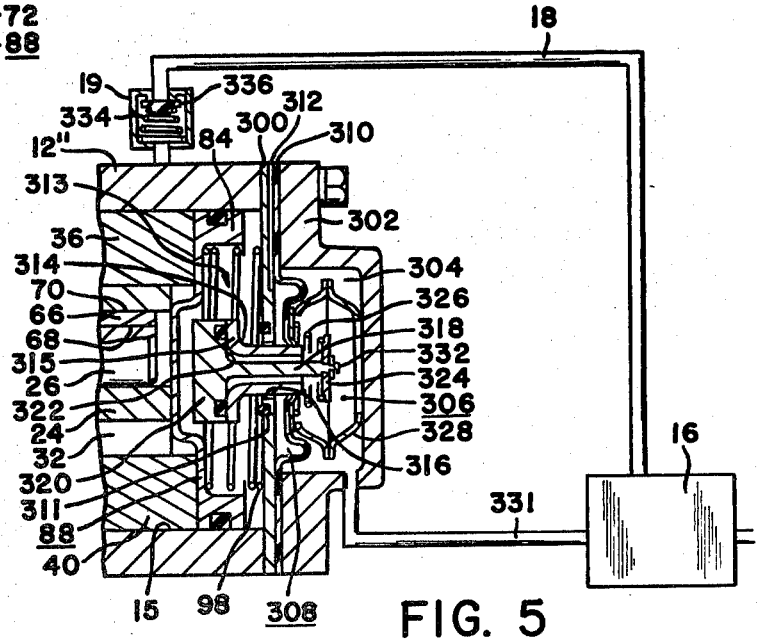
FIG. 5 is a sectional view of a portion of the pump of FIG. 1 showing a pneumatic sensor associated with the end plate to control the movement thereof during the development of a pressure differential between the inlet port and the outlet port.

In the embodiments of the invention shown in FIGS. 4 and 5, elements of the pump that are identical to those in FIG. 1 are identified by the same reference number.

The housing 12 of the pump 10' shown in FIG. 4 has a passage 200 that extends from the inlet port 20 to a point substantially adjacent an opening 202 in the side wall. Vanes 204, 206 and 208 which are located in slots 210, 212 and 214 engage surface 15' to define a series of chambers 216, 218 and 220 in cavity 14. The size of opening 202 and the position of the vanes 204, 206 and 208 are selected so that the inlet and outlet ports 20 and 22 are substantially connected to the surrounding environment whenever the closure member 222 is removed from the opening 202.

The closure member 222 has a lever arm 224 that is attached to a pivot pin 226 and a plunger 228 in a solenoid 230. A spring 232 acts on lever arm 224 to hold the plunger 228 out of the solenoid 230 and the closure member 222 against the housing 12' to seal surface 15' from the surrounding environment.

With a pump 10' installed in a vehicle and when the vehicle is operating, rotary input is continually supplied to shaft 26 from the crankshaft. Rotor body 24 rotates in housing 12' to move vanes 204, 206 and 208 past inlet port 20 to draw air from a reservoir and expelling the same to the surrounding environment or exhaust system through the outlet port 22. Whenever the pressure level in the reservoir reaches a level sufficient to operate the accessories while providing sufficient storage for energizing operation, a pressure sensor closes an electrical circuit and allows current to flow to the coils in solenoid 230. With current flowing through the coils in solenoid 230, a magnetic field is created which attempts to center plunger 228 in the center thereof by overcoming spring 232. With movement of the plunger 228, lever arm 224 attached thereto pivots on pin 226 and moves closure member 222 out of engagement with housing 12' to allow fluid communication from bore 15 to the surrounding environment through opening or relief port 202. Passage 200 and the size of opening 202, provide a flow path through which substantially the entire cavity 14' is connected to the surrounding environment at all times. Thus, the resistance to movement of vanes 204, 206 and 208 in cavity 14' is reduced and the work required to rotate shaft 26 substantially eliminated once the pressure level in the reservoir is achieved. Once the pressure level in the reservoir raises, the sensor interrupts the electrical current to the solenoid 230 and spring 232 moves plunger 230 and lever arm 224 to their inactive position as shown in FIG. 4 to again allow fluid to be moved from the inlet port 20 to the outlet port 22.

The pump 10'' shown in FIG. 5, has a bearing wall 300 that is located between housing 12'' and an end cap member 302. End cap member 302 has a cavity 304 located therein that is separated into a sensing chamber 306 and an atmospheric chamber 308 by a diaphragm 310. A groove 312 in the bearing wall 300 communicates air from the surrounding environment into the atmospheric chamber 308.

A poppet valve 313 has a sleeve 314 with a first end attached to the diaphragm 310 and a second end with a radial flange extending therefrom. The sleeve 314 extends through a central opening 316 in the bearing wall 300. A clearance between the central opening 316 and the peripheral surface of the sleeve 314 provides a flow path through which air is communicated from the atmospheric chamber 308 and the control chamber 86 A movable member has a first diameter section 318 separated from a second diameter section 320 by a shoulder 322. The first diameter section 318 extends through the sleeve from the control chamber 86 into the sensing chamber 306. A retainer 324 attached to the end of the first diameter section 318 hold a spring 326 in the sensing chamber 306. The spring 326 acts on the cylindrical member to hold shoulder 322 against flange 315 and prevent communication between the atmospheric chamber 308 and the sensing chamber 306 by way of the control chamber 86 and sleeve 314.

A snap action spring 328 is located in the sensing chamber 304 to hold the diaphragm 310 in a substantially fixed position during the evacuation of air from the reservoir 16.

As with the pump 10 shown in FIG. 1, pump 10'' receives a rotary input from an operating engine causing the rotor 24 to rotate in cavity 14. As vanes 36, 38, 40 and 42 rotate in cavity 14, air is evacuated from reservoir 16 by way of conduit 18.

Sensing chamber 306 is connected to reservoir 16 by conduit 330 so that the fluid pressure level at the inlet port 20 and sensing chamber 306 is identical. As air is evacuated from the reservoir 16, a pressure differential develops across diaphragm 310 between air at atmospheric pressure in chamber 308 and the lower pressure in the sensing chamber 306. However, the diaphragm 310 is held stationary by the force of the snap action spring 328. At some predetermined pressure level in reservoir 16, the pressure differential across diaphragm creates a force sufficient to overcome the force of the snap action spring. When this pressure differential is reached, the snap action spring immediately collapses and diaphragm 310 moves the poppet valve 312 toward the sensing chamber 306. After the diaphragm 310 has moved a predetermined distance, end 332 on the cylindrical member 318 engages housing 302 to establish a flow path between sensing chamber 306 and the control chamber 86. Thereafter, flange 315 engages seal 311 to prevent communication between atmospheric chamber 308 and control chamber 86. With flow communications established between sensing chamber 306 and the control chamber 86, the fluid pressure level at the inlet port 20 and in the reservoir 16 is present in the control chamber 86. Since at least a portion of wall 84 is exposed to the pressure of the surrounding environment, a pressure differential develops across wall 84. When the force from this pressure differential is sufficient to overcome spring 98, wall 84 moves to establish a by-pass chamber 88 in the housing 12'' between the inlet port 20 and outlet port 22. Spring 334 in one-way check valve 19 holds a disc 336 to seal conduit 18 from the by-pass chamber 88 and prevent the dilution of the vacuum level in reservoir 16 with air from the outlet port 22. With the inlet port 20 connected to the outlet port 22, the resistance to movement of vanes 36, 38, 40 and 42 in cavity 14 is reduced and the work required to rotate shaft 26 substantially eliminated.

As the pressure level in reservoir 16 rises from use of the vacuum by accessories, the pressure differential across diaphragm 310 is reduced. At some pressure level, the snap action spring 328 immediately moves the diaphragm 310 toward the atmospheric chamber 308 whereby flange 315 is moved off of seal 311 to re-establish fluid communication between the atmospheric chamber 308 and control chamber 86 and allow spring 326 to move shoulder 322 against flange 315 to interrupt fluid communication between control chamber 86 and the sensing chamber 304. With fluid communication established between the control chamber 86 and atmospheric chamber 308, air enters the control chamber and eliminates the pressure differential force acting on the end plate or wall 84 and allows spring 98 to move the wall or end plate 84 into engagement with vanes 36, 38, 40 and 42 and eliminate flow between the inlet and outlet ports 20 and 22 through the by-pass chamber 88. Thereafter, air is evacuated from reservoir 16 by being drawn through the inlet port 20 and moved through the cavity by the vanes 36, 38, 40 and 42 before being expelled from outlet port 22. When the vacuum level in reservoir 16 again reaches a predetermined pressure level, the pneumatically operated poppet valve 312 is activated and the fluid communication between the inlet and outlet port 20 and 22 re-established to provide substantially unrestricted movement of the vanes 36, 38, 40 and 42 in the chamber 14.

From experimental data accumulated with pump 10, 10' and 10'' it is estimated that the operation work requirement of an engine has been reduced from about 5% to 2% which could result in an increase in fuel mileage up to 4 miles per gallon. Thus, this invention contributes to the overall efficiency of the utilization of fuel in a vehicle and as such, should be considered as an important combination whenever vacuum operated accessories are used in vehicles equipped with diesel engines.

I claim:

1. In a pump having a housing with an operational cavity therein, a rotor having vanes located in the operational cavity and an input member for moving the rotor in said cavity to move a fluid from an inlet port to an outlet port through the cavity and thereby to create a fluid pressure differential between the inlet port and the outlet port, the improvement comprising:

by-pass means for connecting the outlet port to the inlet port when the fluid pressure differential reaches a predetermined level to substantially reduce the resistance to movement of the rotor in the operational cavity;

a control cavity located in the housing;

an end plate located in said housing to separate the control cavity into a by-pass chamber and a control chamber, said by-pass chamber being connected to a series of chambers between the vanes, and said control chamber being connected to said inlet port; and first resilient means located in said control cavity for urging said end plate toward the vanes to attenuate fluid communication through said by-pass chamber, said fluid pressure differential acting across said end plate and overcoming said first resilient means when the predetermined level is reached to move the end plate and allow communication from the inlet port to the outlet port through the by-pass chamber;

a diaphragm for separating the control chamber from a sensing chamber, said sensing chamber being connected to said inlet port and said control chamber, said control chamber being connected to said surrounding environment;

a valve carried by said diaphragm having a poppet assembly therein for controlling communication between said control chamber and said sensing chamber; and second resilient means located in said sensing chamber urging said diaphragm toward the control chamber, said diaphragm responding to a sensed pressure differential created by air from the environment on one side of the diaphragm and the fluid pressure at the inlet port in the sensing chamber by overcoming said second resilient means to move said valve to interrupt fluid communication between the control chamber and the surrounding environment while initiating fluid communication between said sensing chamber and the control chamber to develop said fluid pressure differential across said end plate.

2. In the pump as recited in claim 1 wherein said poppet assembly of the valve includes:

a sleeve member having a first end attached to said diaphragm and a second end with a radially extending outward flange therefrom;

a movable member having a first diameter section separated from a second diameter section by a shoulder, said first diameter extending through said sleeve into said sensing chamber; and a third resilient means connected to said movable member for urging said shoulder against said flange to present fluid communication through said sleeve during the development of said sensed pressure differential, said second resilient means holding said diaphragm substantially stationary until the sensed pressure differential reaches a predetermined level and thereafter immediately responds to the force developed across the diaphragm by collapsing and allowing the diaphragm to move in the sensing chamber until said flange on the sleeve member engages a seat to interrupt fluid communication from the surrounding environment prior to said flange engaging said seat, the end of said first diameter section engaging said housing to hold the cylindrical member stationary and establish a flow path through said sleeve between the sensing chamber and the control chamber as said flange moves away from said shoulder and allows said fluid pressure differential to develop across the end plate.

* * * * *